US005484359A

United States Patent [19]

Wabafiyebazu

[11] Patent Number: 5,484,359

[45] Date of Patent: Jan. 16, 1996

[54] CHIN MUSCLES TONIFIER

[76] Inventor: Germano N. Wabafiyebazu, 280 Crichton Street, Apt. 5, Ottawa, Ontario, Canada, K1M 1W4

[21] Appl. No.: 176,647

[22] Filed: Jan. 3, 1994

Related U.S. Application Data

[63] Continuation-in-part of Ser. No. 942,856, Sep. 10, 1992, abandoned.

[51] Int. Cl.[6] ..... A63B 9/16

[52] U.S. Cl. ..... 482/11; 482/121; 482/10; 482/124

[58] Field of Search ..... 602/74, 90, 902; 2/9, 425; 27/25.1; 128/848; 433/5; 482/121, 11, 10, 124

[56] References Cited

U.S. PATENT DOCUMENTS

| | | | |
|---|---|---|---|
| 649,896 | 5/1900 | Baughman | 602/74 |
| 1,274,636 | 8/1908 | Tucker | 606/204.35 |
| 1,587,558 | 6/1926 | Sheffield | 128/848 |
| 1,992,904 | 2/1935 | Preston | 602/17 |
| 2,507,617 | 5/1950 | Swendiman | 602/17 |
| 3,541,608 | 11/1970 | Otwell | 602/74 |
| 3,759,256 | 9/1973 | O'Malley | 607/17 |
| 4,650,182 | 3/1987 | Ross | 482/11 |
| 5,035,420 | 7/1991 | Beeuwkes II et al. | 482/11 |

FOREIGN PATENT DOCUMENTS

| | | | |
|---|---|---|---|
| 2322078 | 12/1973 | Germany | 482/10 |

*Primary Examiner*—Richard J. Apley
*Assistant Examiner*—Jerome Donnelly
*Attorney, Agent, or Firm*—McFadden, Fincham

[57] ABSTRACT

There is disclosed an exercise device for exercising the facial muscles of a user. The device includes a first elastic strap for encircling the face of a user. The elastic strap is secured in position over the forehead and under the chin by a plurality of additional straps. One of the straps of the device, when in use, is positioned beneath the ears for maintaining stability of the elastic strap and preventing lateral movement of the jaw during use.

7 Claims, 2 Drawing Sheets

CHIN MUSCLES TONIFIER

This is a continuation-in-part application of U.S. application Ser. No. 07/942,856 filed Sep. 10, 1992, now abandoned.

FIELD OF THE INVENTION

The present invention relates to an exercise device for toning up the chin, jaw, cheeks, neck, nape of the neck, forehead, trapezius and scalp muscles, and more particularly, this invention relates to a device for exercising these muscles through contraction, when the user opens his mouth.

BACKGROUND OF THE INVENTION

At this stage of technology in gymnastic equipment, there is no portable equipment especially conceived to simultaneously and effectively tone up the neck, chin, jaw and cheek muscles.

Generally, the prior art includes: The *Jaw Exercise Device*, U.S. Pat. No. 4,650,182; the *Facial Muscle Exerciser*, German Patent No. 2,322,078 and the *Jaw Bracing and Setting Appliance*, U.S. Pat. No. 1,587,558 cannot foster a sufficient resistance to fight against the accumulation of fat under the chin, the nape of the neck, the cheeks and the trapezius. Their technical characteristics do not allow them to be equipped with elastics of sufficiently large calibre or power capable to offer, when the user opens his mouth, a strong resistance to the muscles while remaining functional.

The other inventions referring to the chin: *Splint for Immobilization of the Mandible*, U.S. Pat. No. 3,759,256 of September 1973; *Eyes Shield for Infants*, U.S. Pat. No. 3,541,608; *Jaw Support*, U.S. Pat. No. 2,507,617; *Jaw Brace*, U.S. Pat. No. 1,992,904 and *Head-Bandage*, U.S. Pat. No. 649,896 are instruments whose main purpose is to immobilize the jaw.

SUMMARY OF THE INVENTION

One object of the present invention is to provide an improved exercise for toning up the chin, jaw, neck, cheeks, nape of the neck, forehead and scalp muscles.

A further object of one embodiment of the present invention is to provide a facial exercise device for exercising the facial muscles of a user comprising a face encircling member, the face encircling member including a stretchable elastic means having a padded covering adapted to substantially encircle a user's head about the facial area and adapted to extend thereabout from a user's forehead to beneath a user's chin, the face encircling member configured to provide a substantially unobstructed opening for acceptance of the face of a user, whereby the stretchable elastic means provides tension around a user's face for exercising the facial muscles of the user, the face encircling member including means for adjustably mounting and positioning the face encircling member about a user's face, the means for adjustably mounting and positioning including a first rearwardly extending lower mounting tension adjusting belt means fixedly secured to the face encircling member at one side thereof and adjustably secured to an opposite side thereof at a point adapted to be positioned between a user's chin and a user's forehead, a second rearwardly extending top tension adjustable belt means connected at one end to the face encircling member at an upper forehead portion of the face encircling member, a rearwardly located non-extendable carrier and positioning member connected to and extending from the second top belt means to the first lower belt means, the lower belt means being slidably mounted and positioned by the carrier and positioning member, and positionable to thereby mount the lower belt below a user's ears at the back of a user's head, and the second top belt means being connected at another end other than the one end to the carrier and positioning member to position the top belt means on a user's head.

The device includes an elastic padded ring (spring). Five belts, in one embodiment are connected to one side of the ring; a belt-carrier equipped in its upper part with a belt; two bearings or auxiliary carriers; and five strong elastics attached to the other flank and to the upper part.

Due to the padded elastic ring encircling the user's face from the top of the head to under the chin; to the belts strategically attached to the elastic ring (at the centre of the forehead at the side of the forehead, level with the eyes, level with the cheek-bones, on the cheeks level with the jaw), all maintained behind the head by the belt-carrier acting as a knot for the diverse belts, then buckled to one of the ring flanks to powerful elastics; this invention can be equipped with powerful springs offering great resistance to the user while he/she opens and closes his (her) mouth, while being at the same time firmly and comfortably kept on the head.

Having thus generally described the invention, reference will now be made to the accompanying drawings illustrating preferred embodiments.

DETAILED DESCRIPTION OF THE PREFERRED EMBODIMENTS

Figure 1:
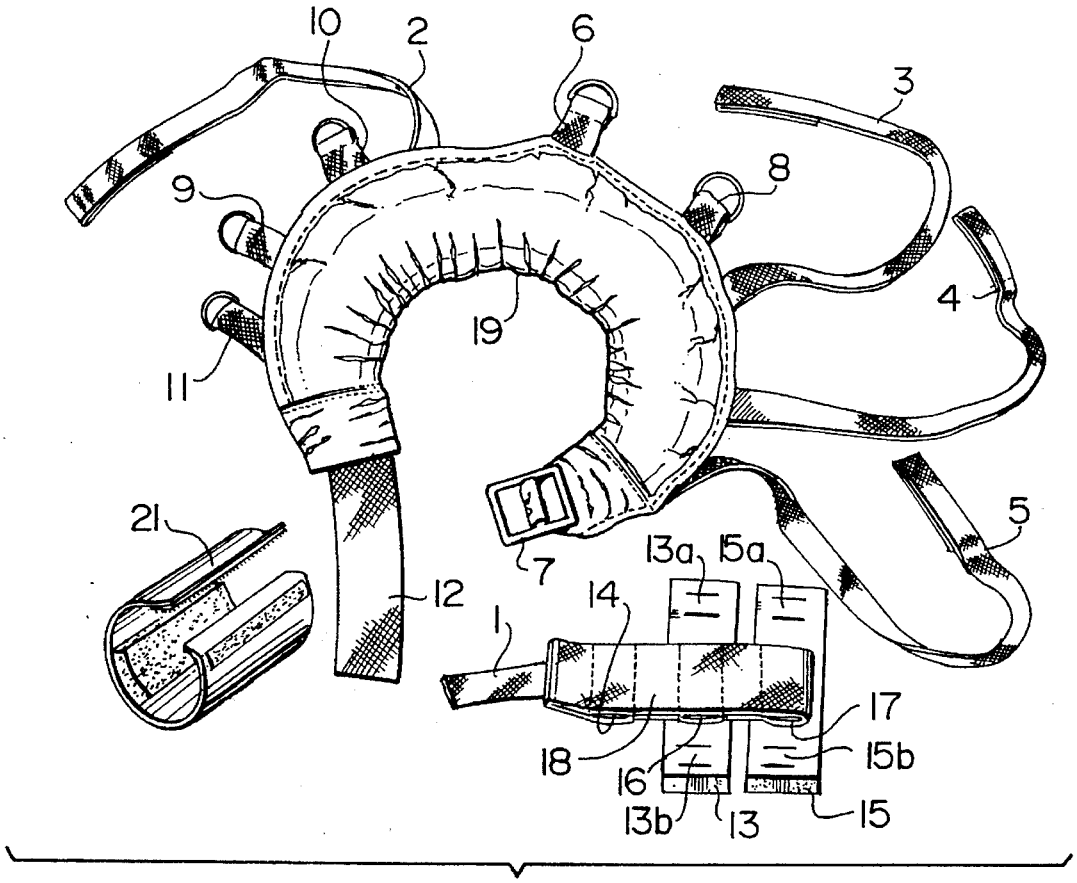
FIG. 1 is a detailed view of the unbuckled components according to one embodiment of the invention.

FIG. 1 shows the device according to the present invention in unassembled form with its different detached components. The components include a stretchable elastic padded spring 19 for encircling the face of a user 20 (FIG. 5) equipped at its extremities with a buckle 7 and a belt 12 for adjustably mounting and positioning the padded spring 19 about a user's face. Belts 2,3,4,5 and the elastics equipped with double buckles 6,8,9,10,11; a padded belt carrier 18 equipped with 3 openings 14,16,17 to which the belt 1 is attached; and two padded carriers 13 and 15 each equipped with two auxiliary belt-carrier members 13*a*,13*b* and 15*a*, 15*b*.

Figure 3:
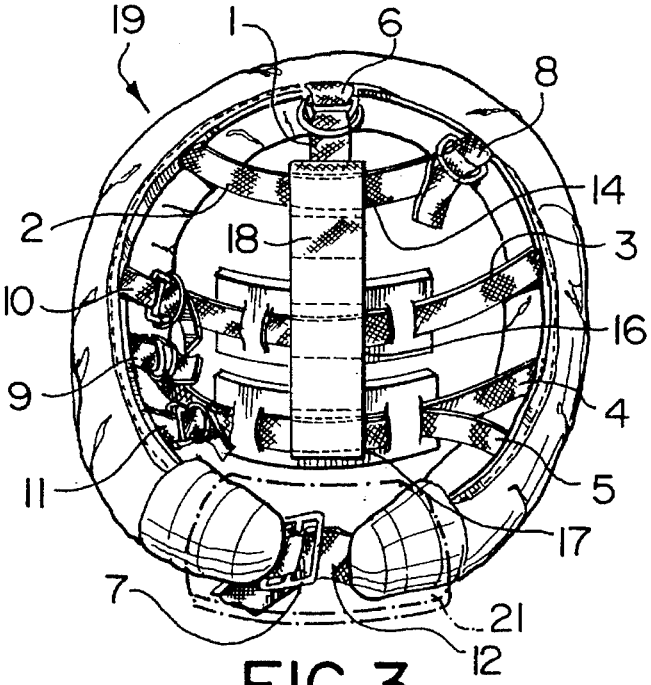
FIG. 3 is a back view of the device.
Figure 4:
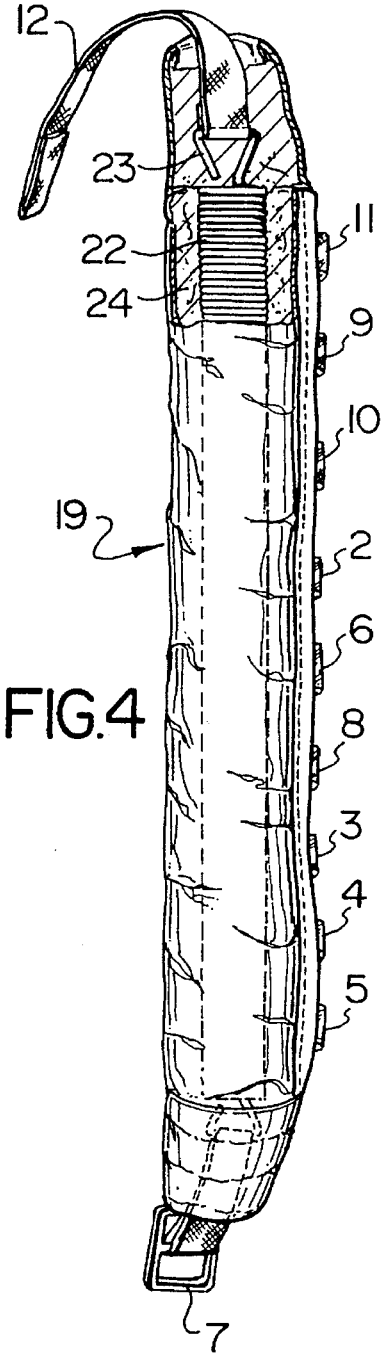
FIG. 4 is a detailed view of the inside of the elastic padded ring.
Figure 5:
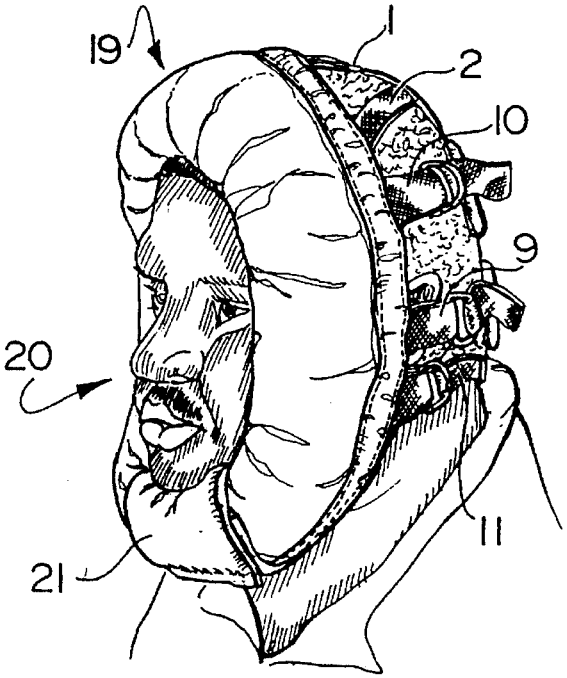
FIG. 5 is a perspective view of the device on the head of a user.

FIG. 3 shows a rear view of the device illustrating the different components of the device. The components are generally connected in the following manner:

Belt 12 connects with the buckle 7 for adjustment about the face of a user 20 (FIG. 5).

Belt 1, the second top belt, attached to belt carrier 14, the latter acting as central pillar to the structure as a whole and as belt carrier for the belts 2,3,4 and 5, connects with the double buckle ring of the elastic 6.

Having passed through belt-carrier, generally denoted by numeral 14, the belt 2 connects to the double buckle ring of the elastic 8.

Having passed through auxiliary belt-carrier 13*a* of carrier 13, through the belt-carrier 16, then through the belt-carrier 13*b* of the carrier, the belt 3 connects to the double buckle ring of the elastic 10.

Having passed through belt-carrier 15*a* of carrier 15, through the belt-carrier 17 then through the belt-carrier 15*b* of carrier 15, the belt 4 connects to the double buckle ring of the elastic 9.

Having passed through the belt-carrier 15*a* of bearing 15, through the belt-carrier 17 then through the belt-carrier 15*b* of bearing 15, the belt 5 connects to the double buckle ring of the elastic 11.

As FIGS. 3 and 5 illustrate, the purpose of the belts 1,2,3,4 and 5 is to extend and restrain the ring 19 around the face 20. As is illustrated, the belt 1 in use is level with the forehead in the centre. Belt 2 is positioned at the sides of the forehead. Belt 3 is generally level with the eyes; lower Belt 4, level with the cheek-bones, and belt 5 level with the cheeks, assist in holding the ring 19 on the chin during the exercise. First lower mounting tension belt 5 also ensures that the jaw remains straight during the exercise, in other words, it prevents the jaw from going left and right.

The purpose of the elastics 6,8,9,10,11 located at the flank of the ring 19 to which the belts 1,2,3,4,5 are joined is to allow the device to better adhere to the head and to weaken the pressure of the ring 19 when the user opens and closes his mouth. Moreover, these elastics, in particular elastics 9 and 11, are an additional source of resistance to the elastic ring 19.

The purpose of the belt-carrier 18 is to keep the belts 1,2,3,4,5 together behind the head as illustrated in FIG. 3 hooked to the nape of the neck. Belt 12 connects with buckle 7 and is used to adjust the strain of the elastic ring 19.

All of these components have to be present for the device to be functional. The purpose of the five belts 1,2,3,4,5 is to extend the elastic ring 19 around the face and to keep it on the head. The diameter of the elastic ring 19 is smaller. It is, when located around the head and kept behind the nape of the neck by the belts buckled to the elastics, extended around the face from the top of the head to the bottom of the chin.

Figure 2:
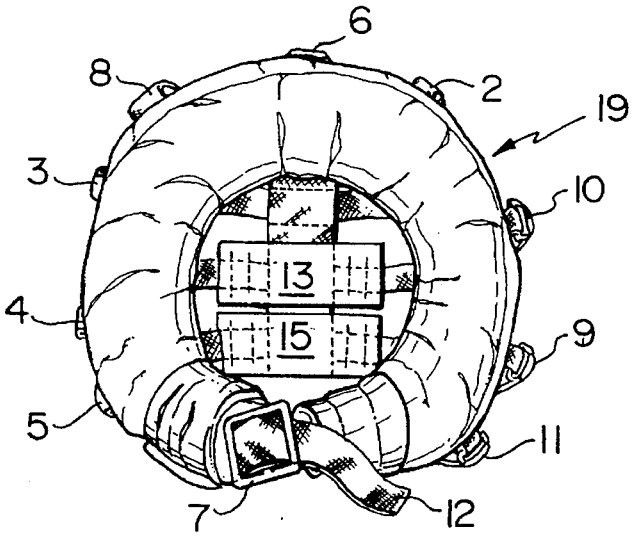
FIG. 2 is a front view of the device.

The device, outside the head, has a smaller diameter; the elastics joined to the extremities of the belts and to the elasticity of the ring allows it to wrap itself around the user's head as is generally illustrated in FIG. 2.

Moreover, as with belt 12, the particular purpose of the belts 1,2,3,4,5 is one of adjusting the tension on the elastic ring 19. Tightening increases its tension and therefore its resistance while loosening reduces tension. Furthermore, their distribution to practically all the muscles of the head allows the simultaneous toning up of the scalp during the exercise.

The strip belt-carrier 18, acting as a holder for the belts, is indispensable for keeping the belts 1,2,3,4,5 in place behind the nape of the neck. The multiple belt-carriers allow the placement of the belts to the belt-carrier best responding to the contours and size of the user's head.

Finally, the auxiliary carriers 13,15 temper the contact of the belts 1,2,3,4,5 against the user's nape of the neck.

The strip belt-carrier 18 and auxiliary carriers 13 and 15 may be padded for cushioning as set forth herein previously or alternatively, may be composed of a foam material in order to ensure comfort.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A facial exercise device for exercising the facial muscles of a user comprising:

a face encircling member, the face encircling member including:

a stretchable elastic means having a padded covering adapted to substantially encircle a user's head about the facial area and adapted to extend thereabout from a user's forehead to beneath a user's chin, the face encircling member configured to provide a substantially unobstructed opening for acceptance of the face of a user, whereby the stretchable elastic means provides tension around a user's face for exercising the facial muscles of the user, the face encircling member including means for adjustably mounting and positioning the face encircling member about a user's face, the means for adjustably mounting and positioning including:

a first rearwardly extending lower mounting tension adjusting belt means fixedly secured to the face encircling member at one side thereof and adjustably secured to an opposite side thereof at a point adapted to be positioned between a user's chin and a user's forehead, a second rearwardly extending top tension adjustable belt means connected at one end to the face encircling member at an upper forehead portion of the face encircling member, a rearwardly located non-extendable carrier and positioning member connected to and extending from the second top belt means to the first lower belt means, the lower belt means being slidably mounted and positioned by the carrier and positioning member, and positionable to thereby mount the lower belt below a user's ears at the back of a user's head, and the second top belt means being connected at another end other than the one end to the carrier and positioning member to position the top belt means on a user's head.

2. The exercise device as claimed in claim 1, wherein said stretchable elastic means comprises a spring member.

3. The exercise device as claimed in claim 1, wherein each of said adjustable belts includes a buckle for receiving and adjusting a belt.

4. The exercise device as claimed in claim 1, wherein said carrier and positioning member includes a plurality of openings for receiving said belts.

5. The exercise device as claimed in claim 4, wherein said carrier and positioning member includes auxiliary carrier members connected thereto for receiving at least said first lower mounting tension adjusting belt means.

6. The exercise device as claimed in claim 1, wherein said carrier and positioning member includes padding material.

7. The exercise device as claimed in claim 5, wherein said auxiliary carrier members include padding material.

* * * * *